US006592637B2

(12) United States Patent
McGee et al.

(10) Patent No.: US 6,592,637 B2
(45) Date of Patent: Jul. 15, 2003

(54) DECORATIVE CANDLE AND PROCESS FOR MAKING SAME

(76) Inventors: Thomas McGee, 36 Avalon Garden Dr., Nanuet, NY (US) 10954; Richard P. Sgaramella, 1036 Garden St., Hoboken, NJ (US) 07030

( * ) Notice: Subject to any disclaimer, the term of this patent is extended or adjusted under 35 U.S.C. 154(b) by 106 days.

(21) Appl. No.: 09/810,383

(22) Filed: Mar. 16, 2001

(65) Prior Publication Data

US 2002/0168600 A1 Nov. 14, 2002

(51) Int. Cl.[7] ..... C10L 5/00; C11C 5/00

(52) U.S. Cl. ..... 44/275; 44/265; 44/268; 431/288; 431/289; 431/291

(58) Field of Search ..... 44/275, 265, 268; 431/288, 289, 291

(56) References Cited

U.S. PATENT DOCUMENTS

| | | | | |
|---|---|---|---|---|
| 2,638,411 | A | | 5/1953 | Thompson et al. |
| 3,074,849 | A | | 1/1963 | Buckwalter et al. |
| 3,074,892 | A | | 1/1963 | Kulka et al. |
| 3,645,705 | A | | 2/1972 | Miller et al. |
| 3,771,445 | A | | 11/1973 | Campbell et al. |
| 3,819,342 | A | | 6/1974 | Gunderman et al. |
| D246,010 | S | | 10/1977 | Tanikawa |
| 4,118,203 | A | | 10/1978 | Beardmore et al. |
| 4,187,251 | A | | 2/1980 | Schleppnik |
| 4,622,221 | A | | 11/1986 | Schleppnik |
| 4,719,105 | A | | 1/1988 | Schleppnik |
| 4,759,709 | A | | 7/1988 | Luken, Jr. et al. |
| 5,395,233 | A | | 3/1995 | Karp |
| 5,578,089 | A | | 11/1996 | Elsamaloty |
| D397,459 | S | | 8/1998 | Hsu |
| D407,164 | S | | 3/1999 | Bell et al. |
| 5,879,694 | A | * | 3/1999 | Morrison ..... 44/629 |
| 5,884,639 | A | * | 3/1999 | Chen ..... 524/474 |
| 5,927,964 | A | | 7/1999 | Fawcett |
| 5,998,570 | A | | 12/1999 | Pavlin et al. |
| 6,054,517 | A | | 4/2000 | Spaulding et al. |
| 6,066,329 | A | * | 5/2000 | Morrison et al. ..... 44/269 |
| 6,068,472 | A | | 5/2000 | Freeman et al. |
| 6,096,102 | A | * | 8/2000 | Matthal et al. ..... 44/275 |
| 6,111,055 | A | | 8/2000 | Berger et al. |
| 6,129,771 | A | * | 10/2000 | Ficke et al. ..... 44/275 |

FOREIGN PATENT DOCUMENTS

| | | | |
|---|---|---|---|
| WO | WO-00/53707 | * | 9/2000 |
| WO | WO 00/73408 | | 12/2000 |

* cited by examiner

*Primary Examiner*—Margaret Medley
(74) *Attorney, Agent, or Firm*—Norris McLaughlin & Marucs

(57) ABSTRACT

The present invention is a candle. The candle includes a container having a bottom and a side wall defining a cavity and a top rim delimited by the side wall, a first region containing a material that is opaque at room temperature, which material is disposed within the cavity of the container, a second region containing a polymer-oil blend that is substantially transparent at room temperature, which is disposed within the cavity of the container and adjacent to the first region; and a wick disposed within the container, which passes through both the first and second regions. A process for making such a candle is also provided.

45 Claims, 9 Drawing Sheets

DECORATIVE CANDLE AND PROCESS FOR MAKING SAME

FIELD OF THE INVENTION

The present invention relates to a candle having a first region containing a material that is opaque at room temperature and a second region that is transparent or substantially transparent at room temperature. More particularly, the material comprising each region of the candle is selected and processed to minimize the diffusion of the respective regions into each other and to maintain the original appearance of the candle for as long as possible while the candle bums. A process for making such a candle is also provided.

BACKGROUND OF THE INVENTION

Candles are used as sources of light and often as attractive ornaments. Candles may be made from solid wax compositions. Opaque candles are typically made from paraffin or stearic acid. Paraffin is advantageous because of its lower cost; but, stearic acid has better burning characteristics. To cost optimize the properties of a candle, a mixture of paraffin and stearic acid is often used as disclosed, for example, in Thompson et al., U.S. Pat. No. 2,638,411 or Beardmore et al., U.S. Pat. No. 4,118,203.

The performance properties of a candle may be improved using various techniques. For example, Luken, Jr. et al., U.S. Pat. No. 4,759,709 disclose how to improve wax candles by over-dipping the candle in a blend of specific paraffins, fatty acids, and alpha-alkyl branched carboxylic acids to minimize streaks and color patches.

Making clear or transparent candles is also known. For example, Miller et al., U.S. Pat. No. 3,645,705 disclose a light, clear mineral oil and/or a natural oil as a gel base, a polyamide resin as a gelling agent, and a $C_8$–$C_{10}$ or $C_{12}$ primary alcohol, which enhances the burning characteristics of the oil-polyamide gel system. Gunderman et al., U.S. Pat. No. 3,819,342 disclose a transparent candle composition containing a thermoplastic polyamide resin and a flammable solvent capable of solubilizing the resin at a temperature below about 100° C. to provide a transparent gel-type structure.

Elsamaloty, U.S. Pat. No. 5,578,089 discloses a clear candle containing a two-phase system, which includes an "oil" phase and a "block co-polymer" phase. To achieve desirable properties for a stable, safe, and attractive clear candle, the gel consistency may be controlled by varying the amount, ratio, and types of the copolymers, including di-block and tri-block copolymers.

Spaulding et al., U.S. Pat. No. 6,054,517 disclose a composition for a solid transparent candle containing one or more polyamide resins present in a total amount of about 60-80% by weight of the composition, one or more solubilizers, and one or more emulsifiers. Berger et al., U.S. Pat. No. 6,111,055 disclose ester-terminated dimer acid-based polyamides that may be blended with a solvent to form a gel. The solvent may be flammable, and a wick may be added to the resulting gel to form a candle.

Because candles are also used as decorative ornaments, processes for enhancing their appearance have been sought. For example, Campbell et al., U.S. Pat. No. 3,771,445 disclose the use of screen-printing to provide decorative candles. Bell et al., U.S. Design Pat. No. D 407,164 disclose candles with a pearl-like appearance. Freeman et al., U.S. Pat. No. 6,068,472 disclose a method of making candles that are decorative. Such candles have an inner chamber and an outer layer. Fawcett, U.S. Pat. No. 5,927,964 discloses candles with decorative metal particles. Tanikawa, U.S. Design Pat. No. D 246,010 discloses another ornamental design for a candle. And, Hsu, U.S. Design Pat. No. D 397,459 discloses a candle with a spiral core.

Candles that have multiple colored layers to provide a decorative effect are also known For example, Ficke et al., U.S. Pat. No. 6,129,771 disclose the use of multi-layer gel candles with different colorants. The respective layers, however, are made from the same gel material, and may be differentiated with e.g., different colors and different perfumes. Such candles are disadvantageous because the layers tend to run together during storage, which may require special barrier layers to prevent.

Karp, U.S. Pat. No. 5,395,233 ("'233 patent") disclose a candle with an opaque core and a shell of transparent wax which leaves a gap between the core and the outer shell. This gap is filled with a mixture of the transparent wax and potpourri materials that camouflage any migration of the opaque layer into the outer transparent layer. The '233 patent also discloses that when the candle is lit, the inner wax core is burnt without melting the potpourri layer and outer transparent layer, thus maintaining the integrity and decorative ambiance of the candle provided by the visible potpourri.

In sum, the patents summarized above do not disclose how to manufacture a stable candle composed of adjacent opaque and transparent layers, whereby both layers are used as a fuel source, and migration of the opaque layer into the transparent layer is minimized.

SUMMARY OF THE INVENTION

Accordingly, it would be advantageous to provide a candle that is easy to make, and that has adjacent regions that are transparent (or substantially transparent) and opaque, which regions are stable with respect to migration, and are both used as fuel. Such a candle provides both a decorative effect and a cost effective, stable candle. It would also be advantageous to provide a process for making such a candle.

One embodiment of the invention is a candle that includes a container having a bottom and a side wall defining a cavity and a top rim delimited by the side wall. A first region containing a material that is opaque at room temperature is disposed within the cavity of the container. A second region containing a polymer-oil blend that is substantially transparent at room temperature is disposed within the cavity of the container and is adjacent to the first region. A wick is disposed within the container, which passes through both the first and second regions.

Another embodiment of the invention is a process for producing a candle. This process includes (a) providing a substantially transparent container having a bottom and a side wall defining a cavity and a top rim delimited by the side wall; (b) dispersing into the cavity of the container a flowable material selected from the group consisting of a wax, a fatty acid, or a combination thereof that forms a solid, opaque layer at room temperature; (c) allowing the flowable material to cool to below about 35° C.; (d) dispersing into the cavity of the container a flowable material containing a polymer-oil blend that forms a solid, substantially transparent layer at room temperature; and (e) positioning a wick within the cavity of the container wherein the wick is in contact with both the opaque and substantially transparent layers.

DETAILED DESCRIPTION OF THE INVENTION

The present invention is a candle containing a first region and a second region, both of which are disposed within the cavity of a container. The container is made from a thermostable material and is at least partially transparent. A wick is positioned so as to be in contact with (i.e., passes through) both the first and second regions. Such a candle is both decorative and economical because both regions are used as a fuel source. Moreover, the compositions or materials that form the first and second regions are selected to minimize "running" (i.e., migration) between the first and second layers during prolonged storage.

Figure 1B:
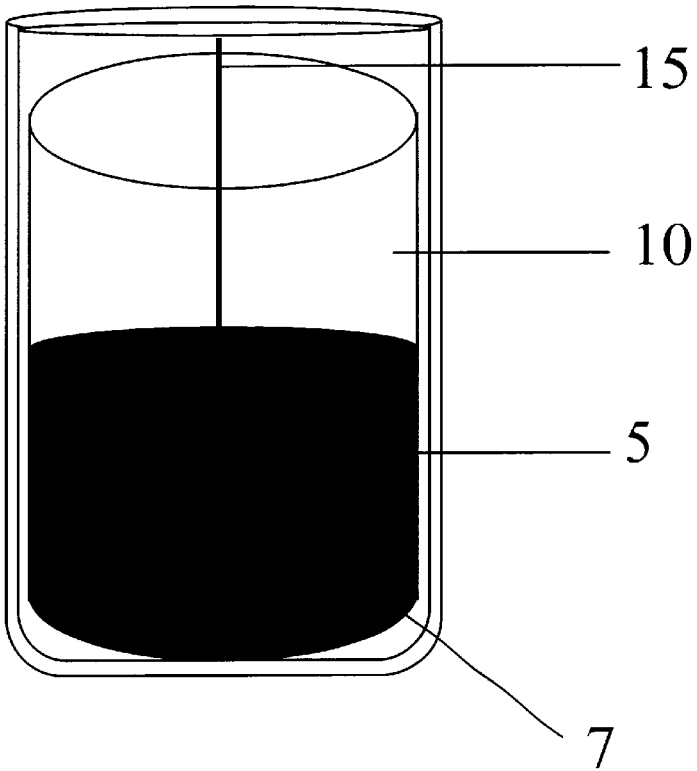
FIG. 1*b* is a perspective view of a container holding a candle in accordance with the present invention with an opaque layer on the bottom and a substantially transparent layer adjacent to, and on top of the opaque layer.
Figure 1A:
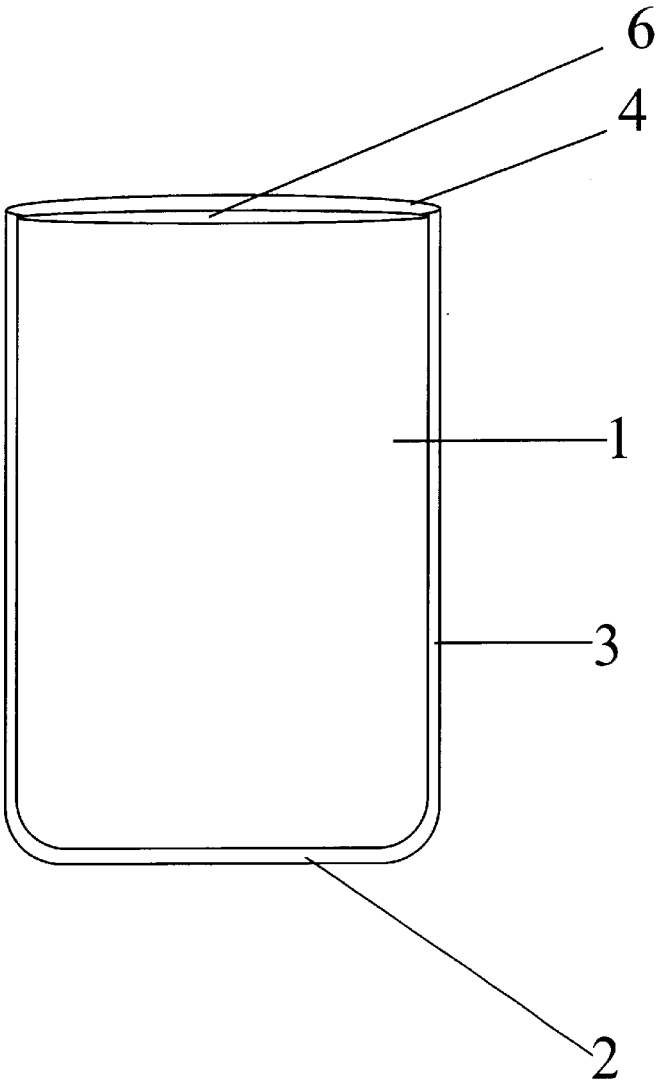
FIG. 1*a* is a perspective view of a transparent, thermostable container according to the present invention.

Turning now to FIG. 1*a*, there is shown a container 1 that has a bottom wall 2 and a side wall 3 that together define a cavity 6. A rim 4 of the container is delimited by the top of the side wall. The container must be made from a thermostable material and be transparent or at least substantially transparent.

Figure 5:
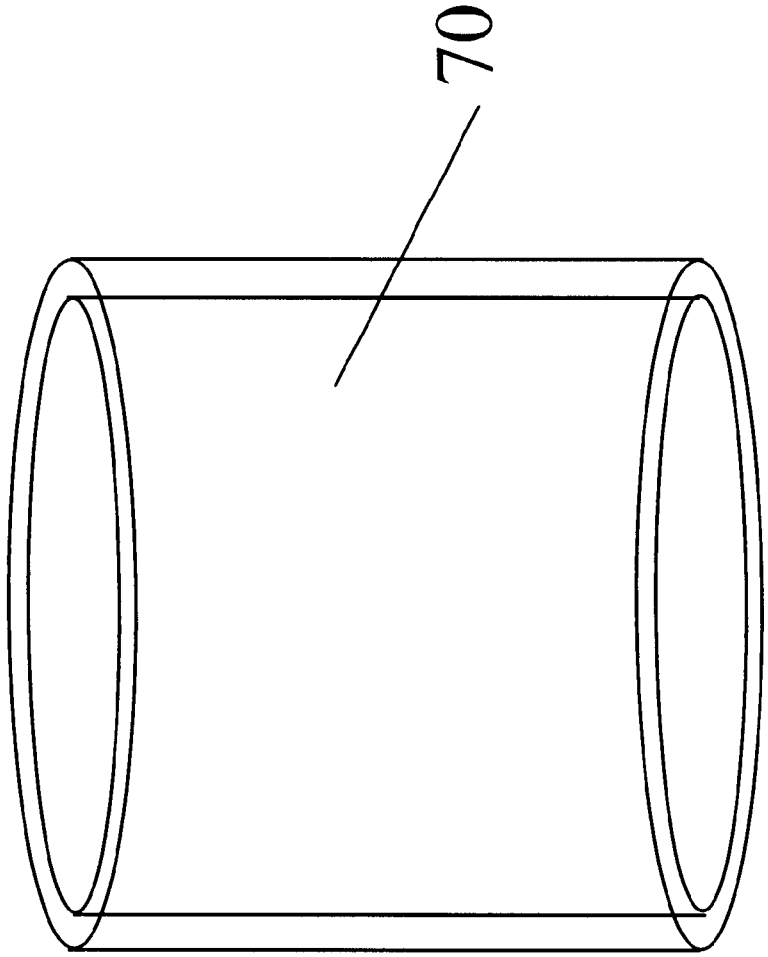
FIG. 5 is a perspective view of a container in accordance with the present invention made of a thermostable, transparent material.

As used herein, a "thermostable material" is one that is heat resistant, and will not bum when housing, e.g., a lit candle. Preferably, as shown in FIG. 5, the container 70 is made from glass. The container may also be made from other thermostable transparent materials, such as thermostable polymers.

Figure 6:
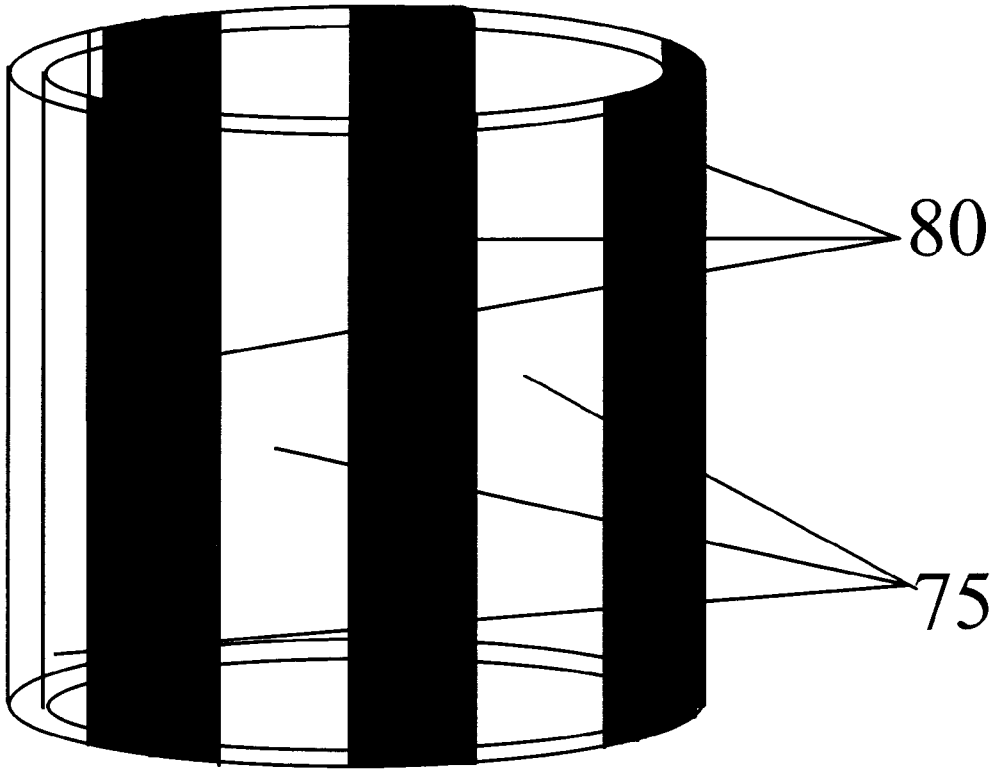
FIG. 6 is an alternative embodiment of the container of FIG. 5 having thermostable, transparent windows dispersed between thermostable, opaque side walls.

In the present invention, a substantially transparent container may be one designed to accommodate transparent panes or windows interspersed between regions that are opaque. For example, FIG. 6 shows a container according to the present invention wherein panes of a transparent, thermostable material 75 are interspersed between panes of an opaque, thermostable material 80. The shape and distribution of the transparent, thermostable material within the surface of the container is not critical, and is selected to provide visually attractive designs. For example, the transparent, thermostable material may take the form of a geometric shape (e.g., circles, squares, triangles, rectangles, etc.), a swirl, or any other design.

The container holds a candle 7 having at least two distinct regions as shown in FIG. 1*b*; a first region 5 containing a material that is opaque at room temperature, and a second region 10 containing a polymer-oil blend that is substantially transparent at room temperature and that is adjacent to the first region. A wick 15 is disposed within the container, and passes through both the first and second regions. The materials selected for the first and second regions respectively must be able to wick and burn.

As used herein, the polymer-oil blend is said to be "transparent" or "substantially transparent" when its transmission light value (L-value) through a 1 cm path length, as measured on a Minolta CT 310 calorimeter, is greater than 90, such as for example 95–100. (See Example 1). Thus, all materials used in the transparent or substantially transparent region must have an L-value greater than 90, and be able to wick and burn.

In the present invention, the material forming the first region may be in the form of a layer that is dispersed, e.g., poured or sprayed, into the bottom of the container. It is important to the present invention that the material forming the first (or bottom layer) of the candle be allowed to cool to below about 35° C., preferably between about 25° C. to about 30° C. Thereafter, the material forming the second region may be dispersed into the container on top of the first layer. The wick (15) can either be attached to the bottom of the container, in the correct orientation, and the first region dispersed around it, cooled, and then the second region dispersed around it and cooled or the wick can be inserted into the first region when it has almost solidified and when the cooling is complete the second region is dispersed around it. Such a candle is shown in FIG. 1*b*.

Figure 2:
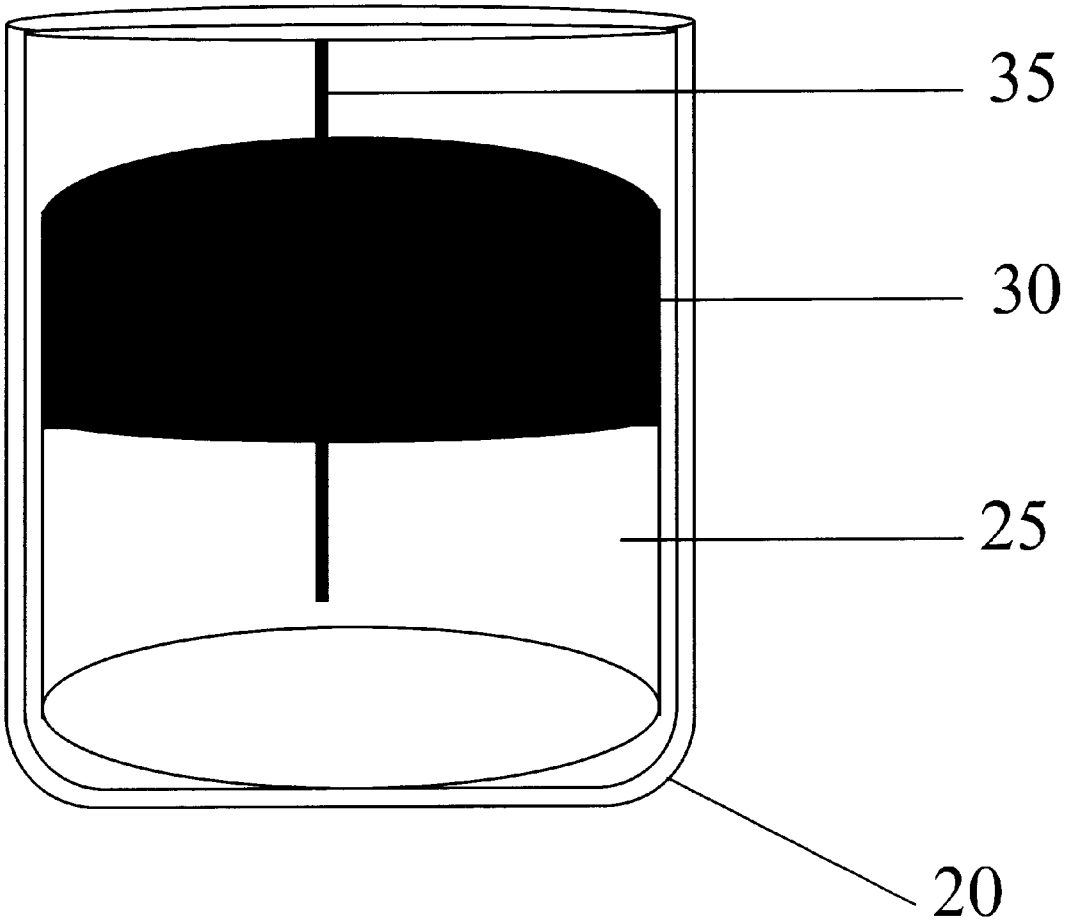
FIG. 2. is a perspective view of a candle in accordance with the present invention with a substantially transparent layer on the bottom and an opaque layer adjacent to, and on top of the substantially transparent layer.

In an alternative embodiment (FIG. 2), the second region 25 (containing a polymer-oil blend that is substantially transparent at room temperature) is dispersed into the container 20 first, allowed to cool to below about 35° C., preferably between about 25° C. to about 30° C., and then the first region (containing a material that is opaque at room temperature) 30 is added. The wick 35 is inserted into the second region before the material solidifies, and passes through both regions once the candle is formed, alternatively the wick can be attached to the bottom of the container in the correct orientation and the respective regions dispersed around it.

As used herein, a "wick" is any filamentary body that is sufficiently sturdy, that will burn with a flame, and that is capable of drawing up the respective materials of the molten candle of the present invention by capillary action. The wick may or may not be coated with wax. Preferably, the wick is not coated with wax. Wicks that may be used in the present invention include, for example, uncoated paper core wicks (44-24-18D) or uncoated zinc metal core wicks (44-32-18Z) obtained from the Candlewick Co. (Ohsville, Pa.). As set forth above, the wick may be positioned in the candle using any convenient technique.

In the present invention, the materials forming the first and second regions are selected so that the melting point of each material enables each region, which is solid at room temperature, to liquefy by radiant heat from the burning wick, and to serve as a fuel source for the burning wick. If the melting point of one or both of the respective materials is too low, the wick will collapse into a pool of molten material, which may possibly ignite. Alternatively, if the melting point of one or both of the materials is too high, the flame will be starved because insufficient fuel will be drawn up through the wick, resulting in the flame being extinguished.

Thus, in the present invention the material forming each region is selected so that upon heating by the candle flame, each material has a viscosity that is low enough for it to be drawn up through the wick by capillary action. The material forming each of the respective regions is optimized so that the candle bums with a luminous and smokeless flame. In addition, the material forming the substantially transparent layer is also optimized to minimize syneresis, i.e., secretion of oil from the gel phase.

In FIG. 1*b*, the first region (5) forms an opaque layer at room temperature. This region is prepared by heating a wax or a mixture of waxes to a temperature above its (or their) melting point(s) (molten phase). Optional ingredients as set forth in more detail below may then be added to the molten wax while mixing. The molten wax is then dispensed into the container and, is cooled. When cooled to room temperature, the wax forms the opaque region (5).

In the present invention, the first region is wax, stearic acid, or mixtures thereof. Preferably, the wax is paraffin. The paraffin wax may be obtained, for example, from Starlight Candles (Bloomington, Minn.), Moore & Munger, Inc. (Shelton, Conn.), or Alene Candles (Milford, N.H.). Preferably, the first region is a mixture of wax and stearic acid, such as for example, from about 20% (wt) to about 98% (wt) of a paraffin wax and from about 80% (wt) to about 2% (wt) of stearic acid, such as from about 60% (wt) to about 80% (wt) of a paraffin wax and from about 40% (wt) to about 20% (wt) of stearic acid.

The second region 10 (in FIG. 1*b*) is a substantially transparent layer at room temperature, and is made from a polymer-oil blend. Such a polymer-oil blend may be prepared by heating and mixing an appropriate polymer and an oil as set forth below to between about 50° C. to about 90° C. to dissolve the polymer in the oil. This polymer-oil blend is flowable at about 50° C. to about 90° C. In the flowable state, the polymer-oil blend is dispensed, e.g., by spraying or pouring, into the container over the first region. On cooling to room temperature, the polymer-oil blend forms a layer consisting of a transparent gel on top of the first region.

In the present invention, the polymer in the polymer-oil blend of the second region is selected from the group consisting of di-block copolymers, tri-block copolymers, radial copolymers, multi-block polymers, ester terminated polyamides, and mixtures thereof. Polymers that may be used in the present invention are commercially available as Versagel C (a mixture of a block copolymer and a white mineral oil in the ratio 5:10 or 85:95 dependent upon the grade) from Penreco (Kams City, Pa.) or Kraton® from Shell Chemical Company. Other polymers that may be used in the present invention include a thermoplastic polyamide resin that is commercially available under the trade name VERSAMID and ester-terminated dimer acid-based polyamides commercially available from, for example, Union Camp Corporation (Wayne, N.J.).

In the present invention, ester terminated polyamides as disclosed for example, in Pavlin et al., U.S. Pat. No. 5,998,570 (which is incorporated by reference as if recited in full herein) having an L-value of greater than 90 may be used as the polymer part of the polymer-oil blend. Such ester-terminated polyamides have the general formula:

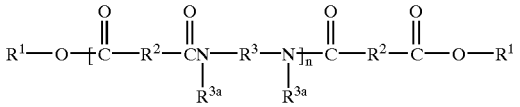

wherein n designates the number of repeating units such that that ester groups constitute from 10% to 50% of the total of the ester and amide groups; each $R^1$ is independently selected from an alkyl or alkenyl group containing at least 4 carbon atoms; each $R^2$ is independently selected from a $C_{4-42}$ hydrocarbon group with the proviso that at least 50% of the $R^2$ groups have 30–42 carbon atoms; each $R^3$ is independently selected from an organic group containing at least two carbon atoms in addition to hydrogen atoms, and optionally containing one or more oxygen and nitrogen atoms: and each $R^{3a}$ is independently selected from hydrogen $C_{1-10}$ alkyl and a direct bond to $R^3$ or another $R^{3a}$ such that the N atom to which $R^3$ and $R^{3a}$ are both bonded is part of a heterocyclic structure defined in part by $R^{3a}$—N—$R^3$, such that at least 50% of the $R^{3a}$ groups are hydrogen.

In the present invention, the oil in the polymer-oil blend may be selected from, white mineral oil, paraffin oil, such as Odina 68 ex Shell, unsaturated fatty alcohols, preferably $C_{10}$–$C_{22}$ alcohols, such as oleyl alcohol, linolenyl alcohol, palmitoleyl alcohol, linolenyl alcohol, ricinoleyl alcohol, and mixtures thereof. The oil may also be selected from saturated fatty alcohols, unsaturated fatty acids, and esters of fatty acids with dihydric alcohols and glycerol.

The saturated fatty alcohols are preferably selected from $C_6$–$C_{14}$ alcohols, such as decanol, dodecanol, hexanol, heptanol, octanol, nonanol, tetradecyl alcohol, and mixtures thereof. Preferably, the unsaturated fatty acids are selected from $C_{10}$–$C_{22}$ acids such as ricinoleic acid, linoleic acid, oleic acid, linolenic acid, erucic acid, decylenic acid, dodecylenic acid, palmitoleic acid, and mixtures thereof.

In the present invention, the esters of fatty acids are made from $C_6$–$C_{18}$ fatty acids and ethylene or propylene glycol. Preferably a glyceride derived from a naturally occurring oil may be used, or the oil itself. Thus, castor oil, which is basically the glyceride of ricinoleic acid, may be used, as well as fatty acid glycerides derived from coconut oil. Other suitable members of this group of esters include propylene glycol monolaurate, propylene glycol stearate, and propylene glycol myristate. In addition to such glycol monoesters, propylene glycol esters derived from oils such as coconut oil also may be used. Mixtures of these esters of fatty acids also may be used.

In the present invention, the ratio of polymer:oil in the polymer:oil blend is from about 5 to about 95, preferably from about 10 to about 90.

The candle may optionally have a fragrance incorporated into one or more of its regions. For purposes of the present invention, the fragrance is a mixture of fragrance materials, selected from such classes as acids, esters, alcohols, aldehydes, ketones, lactones, nitriles, and hydrocarbons. Such fragrance materials are described for example, in S. Arctander Perfume Flavors and Chemicals Vols. 1 and 2, Arctander, N.J. USA. The fragrance materials selected must be able to wick and burn in a candle.

In the present invention, it is preferred that about 0.1% (wt) to about 20% (wt) of the fragrance composition be incorporated into the candle. The fragrance composition may be the same in each region, or if desired, different fragrances may be incorporated into different regions.

One or more optional auxiliary agents may also be incorporated into one or more regions of the candle. As used herein, an "auxiliary agent" is any composition, which imparts a benefit to the candle. The auxiliary agents may include, for example, antiflaring agents, malodor counteractants, antioxidants, antimicrobial agents, colorants, surfactants, emulsifiers, binders, flow agents, insect repellents, insecticides, and mixtures thereof.

Antiflaring agents may be incorporated into any layer of the candle that may tend to flare upon burning. Examples of such materials include stearic acid and the esters thereof, such as isopropyl isostearate, butyl stearate, hexadecyl stearate, isostearyl stearate, and mixtures thereof.

In the present invention, the malodor counteractants are volatilized by burning. As used herein, a "malodor counteractant" reduces the perception of a malodor. Examples of such malodor counteractants are disclosed in Kubelka, U.S. Pat. Nos. 3,074,849, 3,074,892 and 3,077,547 and Schleppnik, U.S. Pat. Nos. 4,187,251, 4,622,221 and 4,719,105 (which are hereby incorporated by reference as if recited in full herein). In the present invention, the malodor counteractants are selected such that they do not adversely affect the burn properties of the candle.

In the present invention, the preferred antimicrobial agents are volatile and include, for example, alcohols such as benzyl alcohol, phenyl ethyl alcohol; 2,4,4'-trichloro-2-hydroxy-diphenyl ether; phenolic compounds, such as phenol, 2-methyl phenol, 4-ethyl phenol; essential oils such as rosemary, thyme, lavender, eugenol, geranium, tea tree, clove, lemon grass, peppermint, or their active components such as anethole, thymol, eucalyptol, farnesol, menthol, limonene, methyl salicylate, terpineol, nerolidol, geraniol, and mixtures thereof.

In the present invention, the insect repellents are preferably volatile when burnt, and include for example, DEET, citronella oil, lavender oil, and cedar oil. Volatile ingredients that are insect repellents are well known in the art. They are selected so as not to adversely affect the burn properties of the candle.

One or more auxiliary agents, as defined above, may also be mixed into the fragrance or added directly to the candle.

Figure 3:
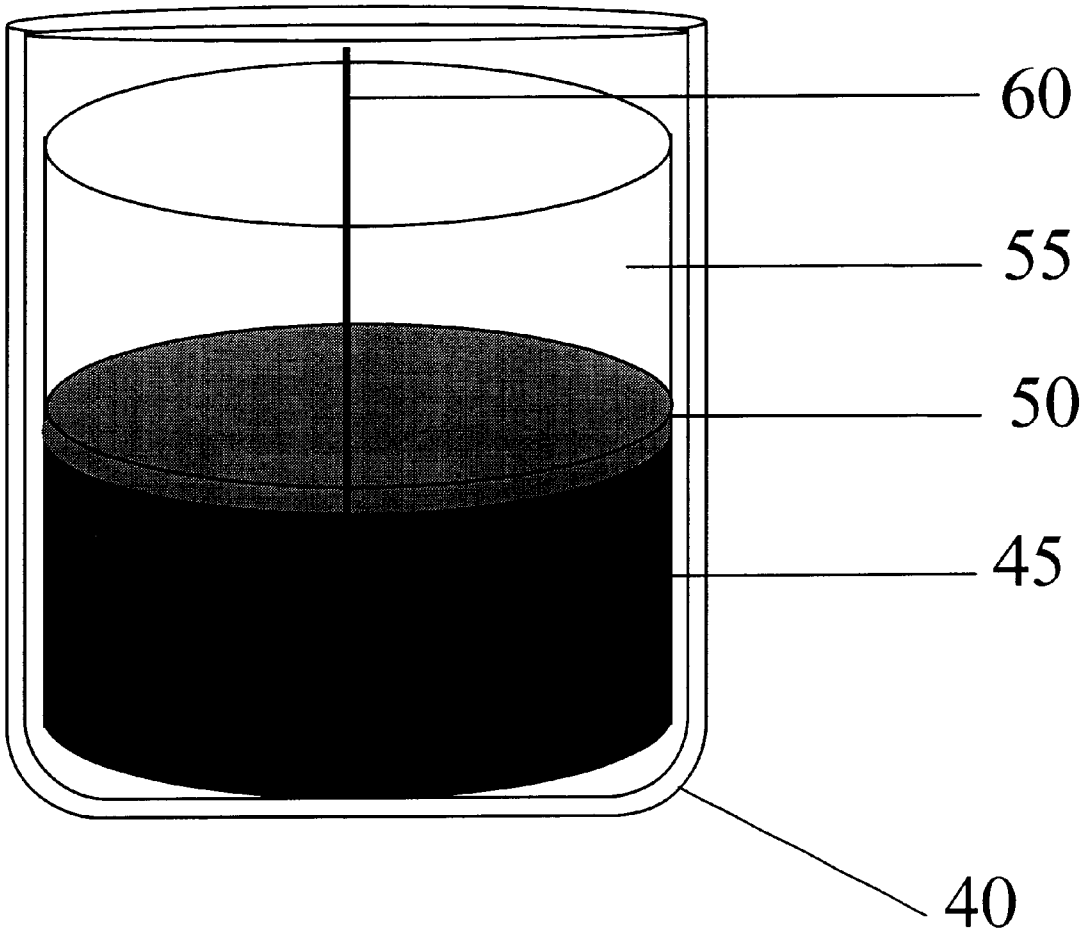
FIG. 3 is a perspective view of a candle in accordance with the present invention with a barrier layer separating the first and second regions.

Turning now to FIG. 3, an alternative embodiment of the invention is shown in container 40. In this embodiment, a barrier layer 50 is disposed between the first region 45 and the second region 55 with a wick 60 in contact with the first region, the second region, and the barrier region.

In this embodiment, the first region is, e.g., poured into the container, a wick is inserted therein, and allowed to cool to a temperature of less than about 35° C., preferably between about 25° C. to about 30° C., after which a thin layer (of approximately 0.5 to 3.0 mm in depth, such as for example 1 mm in depth) of a high melting point barrier material is applied thereover (by e.g., pouring or spraying) at a temperature slightly above its melting point. The barrier layer is then allowed to cool to, e.g., room temperature, before application of the second layer.

Alternatively, the barrier layer may be applied over the first region as a mixture in a volatile solvent so that the barrier layer covers the first region with a thin layer after the solvent evaporates off. This barrier layer is allowed to form a solid phase barrier prior to e.g., pouring the second layer 55 into the container at a temperature just above its melting point. In this embodiment, however, the materials of the respective first and second regions may be reversed.

In the present invention, the use of the barrier layer is optional, and adds increased protection against intermixing of the respective regions during long-term storage, and storage in environments with high temperatures.

The barrier layer that is formed upon cooling to room temperature is a high melting point solid that will burn. Suitable materials for use as the barrier layer include, for example, a wax that has a melting point greater than 60° C., preferably greater than 70° C. Examples of such a wax are synthetic Beeswax SP 58, M.P. 75° C. (from Strahl & Pitsch Inc., West Babylon, N.Y.), refined Beeswax 8012-89-3 M.P. 70° C. (from Frank B. Ross Co. Inc Jersey City, N.J.), and Translucent Wax MP 80° C. (from Candles & Supplies, Coopersburg Pa.). Other barrier materials having the melting point and burn characteristics specified herein are also contemplated by the present invention.

Figure 4:
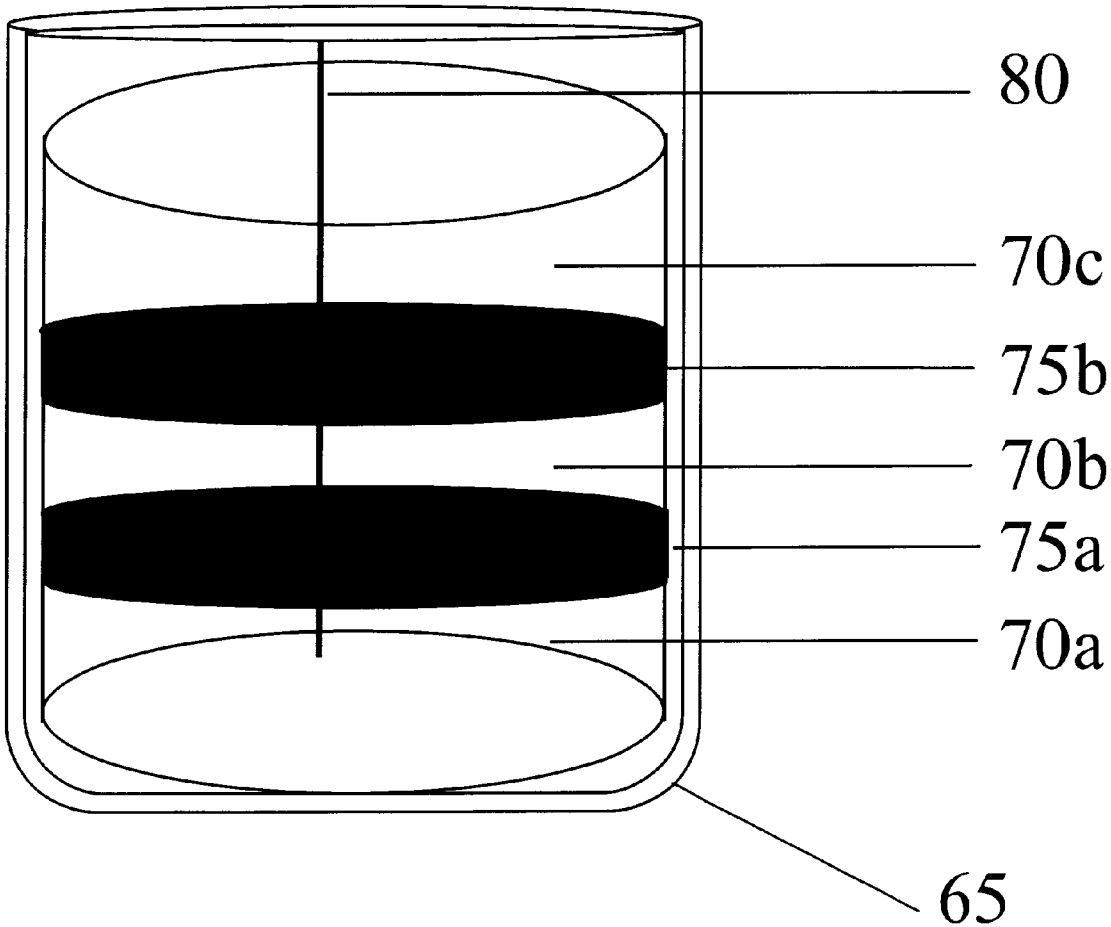
FIG. 4 is a perspective view of a candle in accordance with the present invention having alternating layers of opaque and substantially transparent material.

In another embodiment of the invention, the respective regions of the candle may form decorative designs. For example, FIG. 4 shows alternating regions (70*a*, 70*b*, 70*c*) that are substantially transparent at room temperature, which are interspersed as layers between regions (75*a*, 75*b*) that form opaque layers at room temperature in container 65. The wick 80 is positioned to be in contact with each region. Although FIG. 4 shows three layers of substantially transparent material interspersed between two layers of opaque material, the number and distribution of the respective layers may vary depending on the size of the container and the desired visual effect. (See Example 7).

Figure 7B:
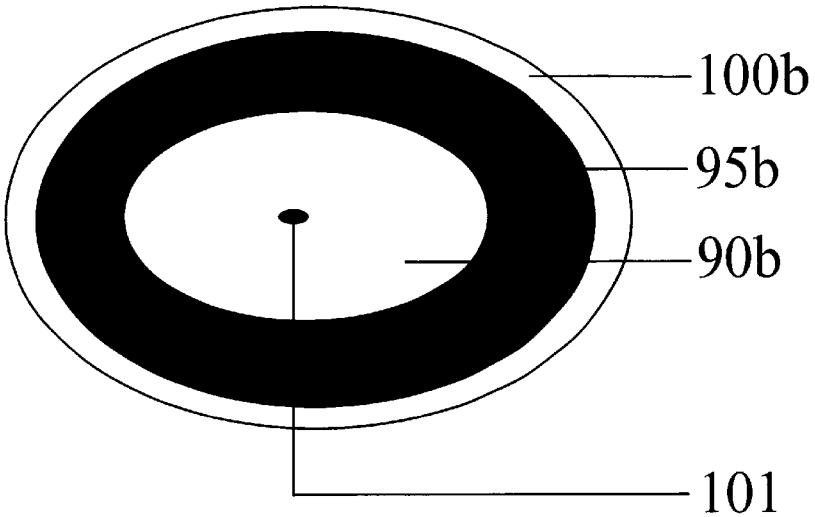
FIG. 7*b* is a top view of an alternative embodiment of a candle of the present invention having a cylindrical core that is substantially transparent at room temperature surrounded by an outer shell that is opaque at room temperature.
Figure 7A:
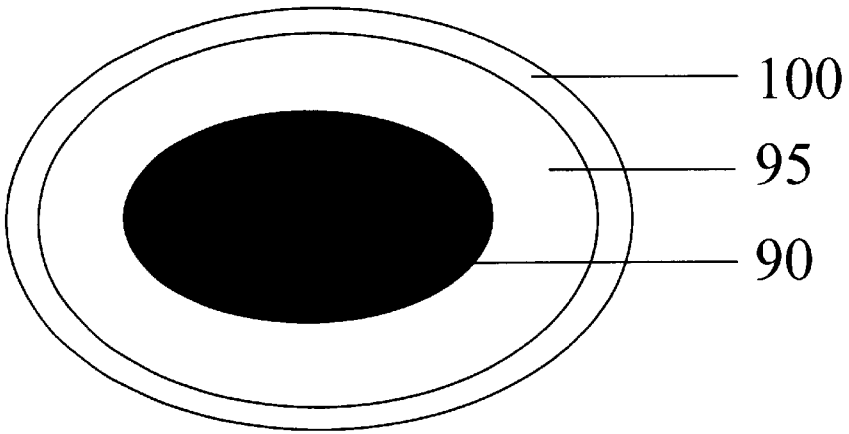
FIG. 7*a* is a top view of an alternative embodiment of a candle of the present invention having a cylindrical core that is opaque at room temperature surrounded by an outer shell that is transparent at room temperature.
Figure 8:
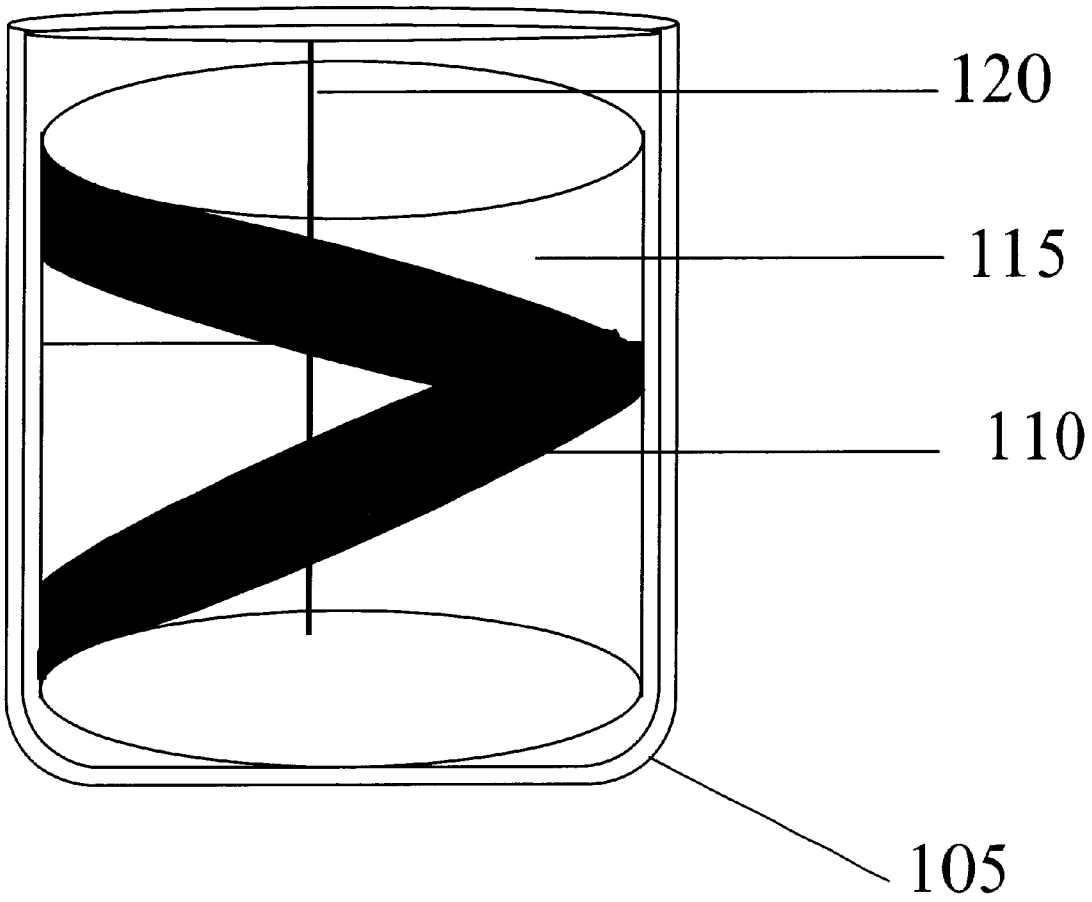
FIG. 8 is an alternative embodiment of the present invention wherein a 'swirl' is formed in the candle.

The respective regions of the candle may be formed into any number of decorative designs, including for example layers as shown in FIGS. 1*b* and 2–4, concentric circles or ellipses (FIGS. 7*a* and 7*b*), and swirls (FIG. 8). As FIG. 7*a* shows, a core 90 made of a material that is opaque at room temperature may be encased by an outer shell 95 that is substantially transparent at room temperature. In this configuration, the core and shell are adjacent to each other, and are encased in container 100 that is open on top. A wick is positioned within the core.

In FIG. 7*a*, the core 90 is prepared by heating wax to its melting point and pouring it into a pillar mold dimensioned in the shape of, e.g., a cylinder of a height that is no taller than the top of the container 100. While in the mold, the wax is cooled until it is soft. At this stage, a wick 101 (see FIG. 7*b*) is inserted into the wax core at a point that runs approximately through a central axis of the wax core. The wax core is then cooled to less than 35° C., preferably between about 25° C. to about 30° C. The core is removed from the mold and placed in container 100 having a diameter that is greater than the diameter of the core. The core is then positioned within the cavity of the container, such as for example, along its central axis.

To form the outer shell, material that is substantially transparent (i.e., a polymer-oil blend having an L-value of greater than 90 as set forth above) at room temperature is heated to its melting point and poured around the opaque core until the outer shell is as high as core. The thus formed candle is then allowed to cool to ambient (room) temperature.

In a similar manner, the candle shown in FIG. 7*b* is formed but with the respective materials used to form the core and outer shell in FIG. 7*a* reversed. As FIG. 7*b* shows, the core 90*b* is made of a material that is substantially transparent at room temperature (i.e., a polymer-oil blend having an L-value of greater than 90 as set forth above) and the outer shell 95*b* is made from a material that is opaque at room temperature. The core and outer shell may be formed into any conventional shape, such as concentric circles, ellipses, squares, etc. using conventional molds. Moreover, the candle may include alternating concentric regions of opaque and substantially transparent materials.

The present invention also provides a process for producing a candle with a decorative appearance whereby the candle is prepared with an opaque and a transparent layer.

The process by which the candle is prepared avoids the subsequent migration of the opaque layer into the transparent layer. The candle, on burning, consumes the layer that is surrounding the burning wick as fuel.

Figure 9:
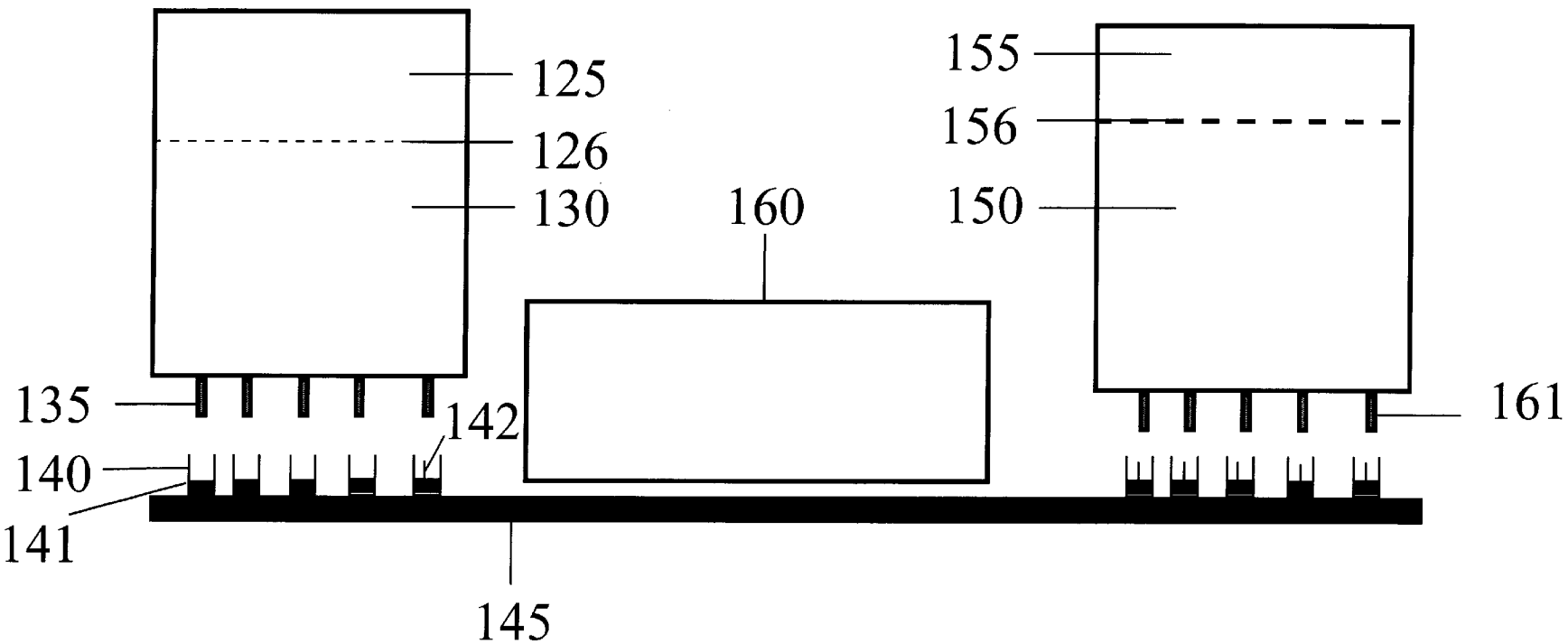
FIG. 9 is a schematic representation of certain steps of a process according to the present invention.

FIG. 9 depicts a process according to the present invention wherein the opaque layer (i.e., wax) 130 is dispensed into container(s) 140 and cooled in, e.g., a cooling tunnel 160 to less than about 35° C., and preferably between about 25° C. and about 30° C., and the transparent layer (i.e., a polymer-oil blend having an L-value of greater than 90 as set forth above) is dispensed into the containers at slightly above the melting point of the polymer-oil blend.

In this embodiment, the wax is housed in a wax melter 125 made from, e.g. stainless steel, that has a heating element 126, which is thermostatically controlled. The wax melter maintains the wax in a molten state, and delivers a predetermined volume of wax into one or more containers 140 through one or more dispensing nozzles 135 to form a first region 141. While the wax is soft, a wick 142 is positioned therein. After traveling through, e.g., a cooling tunnel 160 on, e.g., a conveyor belt 145, the first layer is cooled to less than about 35° C., preferably between about 25° C. to about 30° C. Thereafter, the container(s) is/are moved, by e.g., the conveyor belt, under a gel melter 155, made of, e.g. stainless steel, having a heating element 156 that is thermostatically controlled. The gel melter contains a polymer-oil blend 150 (having an L-value of greater than 90) at a temperature sufficient to maintain the blend in a flowable state. A predetermined amount of the polymer-oil blend is then dispensed into the container through dispensing nozzles 161. Upon cooling to room temperature, a decorative candle according to the present invention is thus formed. If more than two layers are required the second layer is cooled to below about 35° C., preferably between about 25° C. to about 30° C., and the third layer is poured on at just above its melting point and so on until the required number of layers is achieved.

Turning now to FIG. 8, which depicts another embodiment of the invention, a candle containing a "swirl" pattern is created as follows. A first region 115 made from a material that is substantially transparent (i.e., a polymer-oil blend having an L-value of greater than 90 as set forth above) at room temperature is heated to just above its melting point and poured into a suitable container 105. This material is allowed to cool until soft. A metal swirl shaped dye (not shown) is pressed down onto the material forming the first region to shape it into 'swirl'. The dye is gently removed and a wick 120 is inserted into the first region. The shaped first region is cooled to below about 35° C., preferable between about 25° C. and about 30° C. Material that is opaque at room temperature, such as an opaque wax, is heated to just above its melting point, and is poured onto the shaped first region to the desired thickness, and the candle is allowed to cool. The material that is opaque at room temperature forms a second region 110 in the candle that has the appearance of a 'swirl'. The materials comprising the first and second regions may be reversed to obtain a different effect.

Moreover, if a thick 'swirl' is desired, it may be necessary to place onto the second region a 'swirl' shaped dye with a central hole through which to pass the wick. When the second region is cooled to below 35° C., preferable between about 25° C. to about 30° C., the 'swirl' dye is removed, and the candle is completed by adding the first region heated to just above its melting point. The candle is then allowed to cool to ambient temperature.

The following examples are provided to further illustrate various properties of the inventive candles and processes of the present invention. These examples are illustrative only and are not intended to limit the scope of the invention in any way.

EXAMPLES

Example 1

The transparency of various commercially available waxes were evaluated as follows. Light Transmission Readings (L-value) were taken using a 5 ml quartz transmission cuvette with a 1 cm path length on a Minolta CT 310 colorimeter. The L-value is scored on a scale from 0 (Dark) to 100 (transparent). The results are shown below.

| Wax | L-value |
|---|---|
| Penreco Versagel C HP | 100 |
| Kraton Formulation (1) | 97 |
| Ester T Polyamide Formula (2) | 98 |
| Translucent Wax | 41 |
| Starlight Wax | 0 |
| Kraton Formulation | |
| Kraton 1682 | 5.3% |
| Kraton 1650 | 4.2% |
| Paraffin Oil | 90.5% |
| Ester T Polyamide Formula | |
| Ester-terminated polyamide resin (X35-879-48) | 10% |
| Paraffin Oil | 90% |

Based on the results of this experiment, it was determined that all transparent and substantially transparent materials must have an L-value greater than 90, such as 95 to 100.

Example 2

Starlight paraffin wax (Bottom Layer) was heated to 50° C. and poured into a glass container (to form a first region that is opaque at room temperature) and allowed to cool to the respective temperatures shown in Table 1 below. Versagel C HP (that forms a second region that is transparent at room temperature) was heated to 80° C. and poured on top the paraffin wax layer. (See FIG. 1*b*). The formed candle was then allowed to cool to ambient temperature (approximately 25° C.).

Candles made according to the process set forth above were stored for one week at ambient temperature and 40° C., respectively. The candles were then assessed for migration of the opaque layer into the transparent layer using the scale shown below:

1=Zero Migration of opaque phase into transparent phase.

2=Very Slight Migration of opaque phase into transparent phase.

3=Slight Migration of opaque phase into transparent phase.

4=Moderate Migration of opaque phase into transparent phase.

5=Large Migration of opaque phase into transparent phase.

The results of this experiment are presented in Table 1 below.

TABLE 1

| Temp Bottom Layer (° C.) | 25 | 30 | 35 | 40 |
|---|---|---|---|---|
| Storage Ambient Temp | 1 | 2 | 3 | 4 |
| Storage 40° C. | 1 | 2 | 4 | 4 |

As Table 1 shows, when the temperature of the bottom layer ("Temp Bottom Layer") is allowed to cool to between about 25° C. and about 30° C. before the upper (polymer-oil blend) layer is applied, the best results are obtained.

Example 3

Penreco Versagel C HP polymer (Bottom Layer) were heated to 80° C. to form a polymer-oil blend and poured into glass containers (to form a first region that is transparent at room temperature) and allowed to cool to the temperatures indicated below (Table 2). Starlight paraffin wax was heated to 50° C. and poured on top of the polymer-oil blend (to form a second region that is opaque at room temperature). (See FIG. 2). The candles were then allowed to cool to ambient temperature. The candles were stored at ambient temperature and 40° C. and assessed after one week using the scale shown in Example 2. The data are presented in Table 2.

TABLE 2

| Temp Bottom Layer (° C.) | 25 | 30 | 35 | 40 |
|---|---|---|---|---|
| Storage Ambient Temp | 1 | 1 | 2 | 2 |
| Storage 40° C. | 1 | 1 | 2 | 3 |

As Table 2 shows, when the temperature of the bottom layer ("Temp Bottom Layer") is allowed to cool to between about 25° C. and about 30° C. before the upper (paraffin wax) layer is applied, the best results are obtained. At 35° C., the results were also acceptable.

Example 4

Starlight paraffin wax (bottom wax layer) was heated to 50° C. and poured into a series of glass containers and allowed to cool until the wax was soft. The wicks identified in Table 3 below were inserted into the bottom wax layer. The wax was then cooled to 30° C. Penreco C HP was heated to 80° C., and then poured on top of the cooled wax layer and around the wick to form a candle. Each candle containing the wick identified in Table 3 was allowed to cool to 30° C. The candles were stored at 40° C. for one week. The clarity of each "transparent" layer was then assessed visually.

TABLE 3

| Wick Type | Assessment |
|---|---|
| Uncoated paper core wick (44-24-18D) | Transparent layer remained clear on storage and as candle burnt. |
| Wax coated 15 ply wick (DW3-328)* | Slight migration of the wax into the transparent layer. |
| Uncoated zinc metal core wick (44-32-18Z) | Transparent layer remained clear, slight metal residue apparent on surface during burning. |

*Available from the Candlewick Co. (Ohsville, PA).

As the data in Table 3 indicate, the uncoated wicks performed better than the wax coated wicks with respect to preventing migration of the wax into the transparent layer.

Example 5

Two candles were made by heating an polymer-oil containing an ester-terminated polyamide resin (X35-879-48) (10% wt) and Paraffin Oil (90% wt) to 85° C. (at which temperature it was a liquid) and then pouring the resin into two glass containers. An uncoated paper core wick was then inserted into the resin in each container as it cooled (i.e., when it was soft, but not yet solid). The resin was then allowed to cool to 30° C. The resin formed a transparent layer in each container at 30° C.

Paraffin wax was heated to 50° C. and was poured on top of the transparent layer and around the wick to form a candle in each container. One candle was stored at ambient temperature for one week and the other candle was stored at 40° C. for one week. Each candle was then evaluated for migration of the top opaque layer into the bottom transparent layer. After one week, no migration of the top opaque layer into the bottom transparent layer was observed for either candle.

Example 6

The ability of a barrier layer to prevent or minimize migration of the opaque layer into the substantially transparent layer in candles made according to the inventive process was determined. In this example, six candles (A–F) were prepared from five different formulae (1–5). Unless otherwise indicated, all % are % wt.

The following transparent formulae were prepared:

| | |
|---|---|
| Formula 1 | |
| Kraton 1652 | 5% |
| Kraton 1650 | 4% |
| Paraffin oil | 86% |
| Fragrance | 5% |
| Formula 2 | |
| Ester-terminated polyamide resin (X35-879-48) | 9.5% |
| Paraffin Oil | 85.5% |
| Fragrance | 5.0% |
| Formula 3 | |
| Penreco C HP | 95% |
| Fragrance | 5% |

The following wax formulae were prepared:

| | |
|---|---|
| Formula 4 | |
| Starlight Paraffin Wax | 95% |
| Fragrance | 5% |
| Formula 5 | |
| Alene Wax | 95% |
| Fragrance | 5% |
| Formula 6 (Barrier Layer) | |
| Translucent Wax MP 80° C. | 100% |

The transparent formulae were made by heating the oil component to 100° C. and adding the polymer with stirring, and no heat. At about 80° C., fragrance was added to the respective formulae immediately prior to pouring into a glass container. The wax formulae were made by heating the wax to about 50–60° C. The fragrance was added to the respective wax formulae immediately prior to pouring into the glass container.

Candles A–F were made according to Table 4 below. In each candle, the barrier layer wax was heated to 80–85° C. and an approximate 1 mm layer poured to cover the bottom layer. Each layer (bottom, barrier, and top) was cooled to below 30° C. before the next layer added.

TABLE 4

| Candle | Bottom Layer | Barrier Layer | Top Layer |
|---|---|---|---|
| A | Formula 1 | Formula 6 | Formula 4 |
| B | Formula 4 | Formula 6 | Formula 1 |
| C | Formula 3 | Formula 6 | Formula 4 |
| D | Formula 4 | Formula 6 | Formula 3 |
| E | Formula 3 | Formula 6 | Formula 5 |
| F | Formula 5 | Formula 6 | Formula 3 |

The candles were stored at 45° C. in an oven for 24 hours. The candles were removed from the oven and cooled to room temperature. The candles were then visually assessed for migration of the opaque layer into the transparent layer using the scale shown below:

1=Zero Migration of opaque phase into transparent phase.

2=Very Slight Migration of opaque phase into transparent phase.

3=Slight Migration of opaque phase into transparent phase.

4=Moderate Migration of opaque phase into transparent phase.

5=Large Migration of opaque phase into transparent phase.

The data are presented in Table 5 below.

TABLE 5

| Candle | Migration Score |
|---|---|
| A | 2 |
| B | 2 |
| C | 1 |
| D | 1 |
| E | 1 |
| F | 1 |

As Table 4 shows, the barrier wax effectively prevents significant migration of the opaque layer into the transparent layer at elevated storage temperature.

Example 7

Multi-layer candles were prepared as set forth below, and evaluated for clarity and migration after storage at ambient temperature for one month.

Candles 1–8 (See Table 6) having three layers were prepared from formulations #1–#5 set forth below:

Formulation #1—Starlight wax 95%, Fragrance 5%.

Formulation #2—Starlight wax 94.9%, 0.1% of a 1% solution of FD&C Blue Number 1 dye in isopropyl myristate Fragrance 5%.

Formulation #3—Penreco C HP gel, 94.9%, 0.1% of a 1% solution of FD&C Blue Number 1 dye in isopropyl myristate, 5% Fragrance.

Formulation #4—Penreco C HP gel 95% Fragrance 5%.

Formulation #5—Penreco C HP gel 94.8%, Fragrance 5%, 0.1% of a 1% solution Blue FD&C Number 1 dye in isopropyl myristate, 0.1% of Mearle Pearlescent Pigment.

The wax in Formulations #1 and #2 was heated to 50° C. Then, the respective dyes and fragrance were stirred into the heated wax immediately before incorporating into a candle as set forth in Table 5.

The Penreco C HP gels in Formulations #3, #4, and #5 were heated to 80° C. Then, the respective dyes and fragrance were added immediately before incorporating into a candle as set forth in Table 5.

The candles were formed within identical glass containers. Each candle was fitted with an uncoated paper core wick (44-24-18D) that was fixed centrally. Each layer of each candle was poured to approximately one third of the container. Each layer was cooled to approximately 25° C. before the next layer was added.

TABLE 6

| Layer | Bottom | Middle | Top |
|---|---|---|---|
| Candle 1 | #3 | #1 | #3 |
| Candle 2 | #3 | #2 | #3 |
| Candle 3 | #1 | #3 | #1 |
| Candle 4 | #1 | #4 | #1 |
| Candle 5 | #2 | #4 | #2 |
| Candle 6 | #4 | #1 | #4 |
| Candle 7 | #5 | #2 | #5 |
| Candle 8 | #1 | #5 | #1 |

The candles were stored at ambient temperature for 1 month. The clarity of each "transparent" layer was then assessed visually. All transparent layers in all candles remained transparent upon visual inspection. No migration of an opaque layer into a transparent layer was observed.

The invention being thus described, it will be obvious that the same may be varied in many ways. Such variations are not to be regarded as a departure from the spirit and scope of the invention and all such modifications are intended to be included within the scope of the following claims.

What is claimed is:

1. A candle comprising:

(a) a container having a bottom and a side wall defining a cavity and a top rim delimited by the side wall, (b) a first region comprising a material that is opaque at room temperature disposed within the cavity of the container said material which comprises a mixture of from about 20% (wt) to about 98% (wt) of a paraffin wax and from about 80% (wt) to about 2% (wt) of stearic acid, (c) a second region comprising a polymer-oil blend that is substantially transparent at room temperature, which is disposed within the cavity of the container and adjacent to the first region, and (d) a wick disposed within the container, which passes through both the first and second regions.

2. A candle according to claim 1 wherein the container comprises a transparent, thermally stable material, interspersed between an opaque, thermally stable material whereby the transparent material forms decorative shapes on the outer surface of the container and allows for the visualization of the opaque and transparent layers within the cavity of the container.

3. A candle according to claim 1 wherein the wick is not coated with wax.

4. A candle according to claim 3 wherein the material of the first region comprises a mixture of from about 60% (wt) to about 80% (wt) of a paraffin wax and from about 40% (wt) to about 20% (wt) of stearic acid.

5. A candle according to claim 1 wherein the polymer of the polymer-oil blend in the second region is selected from the group consisting of di-block copolymers, tri-block copolymers, radial copolymer, multi-block polymers, ester terminated polyamides resins, and mixtures thereof.

6. A candle according to claim 1 wherein the oil of the polymer-oil blend in second region is selected from the group consisting of white mineral oil, paraffin oil, unsaturated fatty alcohols, saturated fatty alcohols, unsaturated fatty acids, and esters of fatty acids with dihydric alcohols and glycerol.

7. A candle according to claim 1 wherein the ratio of polymer:oil in the polymer-oil blend is from about 5:95.

8. A candle according to claim 7 wherein the ratio of polymer:oil in the polymer-oil blend is from about 10:90.

9. A candle according to claim 6 wherein the unsaturated fatty alcohols contain 10 to 22 carbon atoms.

10. A candle according to claim 9 wherein the unsaturated fatty alcohols are selected from the group consisting of oleyl alcohol, linolenyl alcohol, palmitoleyl alcohol, linolenyl alcohol, ricinoleyl alcohol, and mixtures thereof.

11. A candle according to claim 6 wherein the saturated fatty alcohols contain 6 to 14 carbon atoms.

12. A candle according to claim 11 wherein the saturated fatty alcohols are selected from the group consisting of decanol, dodecanol, hexanol, heptanol, octanol, nonanol, tetradecyl alcohol, and mixtures thereof.

13. A candle according to claim 6 wherein the unsaturated fatty acids have 10 to 22 carbon atoms.

14. A candle according to claim 13 wherein the unsaturated fatty acids are selected from the group consisting of ricinoleic acid, linoleic acid, oleic acid, linolenic acid, erucic acid, decylenic acid, dodecylenic acid, palmitoleic acid, and mixtures thereof.

15. A candle according to claim 6 wherein the fatty acid used in the ester is a $C_6$–$C_{18}$ fatty acid and the alcohol is ethylene or propylene glycol.

16. A candle according to claim 6 wherein the oil is a glyceride derived from a naturally occurring oil.

17. A candle according to claim 6 wherein the oil is selected from the group consisting of castor oil, fatty acid glycerides derived from coconut oil, propylene glycol monolaurate, propylene glycol stearate, propylene glycol myristate, propylene glycol esters derived from oil, and mixtures thereof.

18. A candle according to claim 1 wherein a barrier layer is disposed between the first region and the second region.

19. A candle according to claim 18 wherein the barrier layer is a wax with a melting point greater than 60° C.

20. A candle according to claim 19 wherein the wax has a melting point greater than 70° C.

21. A candle according to claim 1 wherein one or more of the regions contains a fragrance.

22. A candle according to claim 21 wherein the fragrance is incorporated into at least one of the regions at about 0.1% (wt) to about 20% (wt).

23. A candle according to claim 1 wherein at least one of the regions contains an auxiliary agent.

24. A candle according to claim 23 wherein the auxiliary agent is selected from the group consisting of antiflaring agents, malodor counteractants, antioxidants, antimicrobial agents, colorants, surfactants, emulsifiers, binders, flow agents, insect repellents, insecticides, and mixtures thereof.

25. A candle according to claim 24 wherein the antiflaring agent is selected from the group consisting of stearic acid and the esters thereof.

26. A candle according to claim 24 wherein the antiflaring agent is selected from the group consisting of isopropyl isostearate, butyl stearate, hexadecyl stearate, isostearyl stearate, and mixtures thereof.

27. A candle according to claim 24 wherein the antimicrobial agents are selected from the group consisting of benzyl alcohol, phenyl ethyl alcohol, 2,4,4'-trichloro-2-hydroxy-diphenyl ether, phenol, 2-methyl phenol, 4-ethyl phenol, rosemary oil, thyme oil, lavender oil, eugenol oil, geranium oil, tea tree oil, clove oil, lemon grass oil, peppermint oil, anethole, thymol, eucalyptol, farnesol, menthol, limonene, methyl salicylate, terpineol, nerolidol, geraniol, and mixtures thereof.

28. A candle according to claim 24 wherein the insect repellents are selected from the group consisting of DEET, citronella oil, lavender oil, and cedar oil.

29. A candle according to claim 1 wherein the container is a transparent, thermally stable container.

30. A candle according to claim 29 wherein the container is glass.

31. A process for producing a candle comprising:

(a) providing a substantially transparent container having a bottom and a side wall defining a cavity and a top rim delimited by the side wall;

(b) dispersing into the cavity a first flowable material selected from the group consisting of a wax, a fatty acid, or a combination thereof that forms a solid, opaque layer at room temperature wherein the opaque layer is a mixture of paraffin wax and stearic acid, (c) allowing the flowable material to cool to below about 35° C.;

(d) dispersing into the cavity a second flowable material comprising a polymer-oil blend that forms a solid, substantially transparent layer at room temperature; and (e) positioning a wick within the cavity wherein the wick is in contact with both the opaque and substantially transparent layers.

32. A process according to claim 31 further comprising dispersing a barrier layer between the opaque material and the substantially transparent material.

33. A process according to claim 32 wherein the barrier material is poured onto a surface of the first flowable material dispersed into the cavity of the container.

34. A process according to claim 32 wherein the barrier material is sprayed onto a surface of the first flowable material dispersed into the cavity of the container.

35. A process according to claim 31 wherein the barrier layer is formed by dispersing a barrier material at a temperature above its melting point onto a surface of the first flowable material dispersed into the cavity of the container, and allowing the barrier material to form a solid layer before dispersing the second flowable material into the cavity of the container.

36. A process according to claim 31 wherein the polymer in the polymer-oil blend is selected from the group consisting of di-block copolymers, tri-block copolymers, radial copolymers, multi-block polymers, ester terminated polyamide resins, and mixtures thereof.

37. A process according to claim 31 wherein the oil in the polymer-oil blend is selected from the group consisting of white mineral oil, paraffin oil, unsaturated fatty alcohols, saturated fatty alcohols, unsaturated fatty acids, and esters of fatty acids with dihydric alcohols and glycerol.

38. A process according to claim 31 wherein the container is transparent and thermally stable.

39. A process according to claim 38 wherein the container is glass.

40. A process according to claim 31 wherein the flowable material, which is opaque at room temperature is dispersed into the cavity of the container before the flowable material which is substantially transparent at room temperature.

41. A process according to claim 31 wherein the flowable material, which is substantially transparent at room temperature, is dispersed into the cavity of the container before the flowable material which is opaque at room temperature.

42. A process according to claim 40 wherein the flowable material, which is opaque at room temperature is brought to at least 5° C. below its melting point, prior to dispersing the flowable material which is substantially transparent at room temperature into the cavity of the container.

43. A process according to claim 31 wherein the flowable material is allowed to cool to between about 25° C. to about 30° C.

44. A process according to claim 31 further comprising forming alternating layers of substantially transparent and opaque material within the cavity of the container.

45. A process according to claim 31 further comprising forming a decorative design within the cavity of the container with one of the substantially transparent and opaque materials followed by pouring the other material over the decorative design.

* * * * *